US008773089B2

(12) United States Patent
Lai et al.

(10) Patent No.: US 8,773,089 B2
(45) Date of Patent: Jul. 8, 2014

(54) REGULATOR CAPABLE OF RAPIDLY RECOVERING AN OUTPUT VOLTAGE AND A LOAD CURRENT THEREOF

(75) Inventors: Yu-Sheng Lai, Hsinchu (TW); Feng-Chia Chang, New Taipei (TW); Yu-Chou Ke, Taichung (TW)

(73) Assignee: Etron Technology, Inc., Hsinchu (TW)

( * ) Notice: Subject to any disclaimer, the term of this patent is extended or adjusted under 35 U.S.C. 154(b) by 223 days.

(21) Appl. No.: 13/099,375

(22) Filed: May 3, 2011

(65) Prior Publication Data

US 2012/0229106 A1 Sep. 13, 2012

(30) Foreign Application Priority Data

Mar. 8, 2011 (TW) ..... 100107678 A

(51) Int. Cl.
*G05F 1/00* (2006.01)
*G05F 1/563* (2006.01)

(52) U.S. Cl.
CPC ..... *G05F 1/563* (2013.01)
USPC ..... 323/269

(58) Field of Classification Search
USPC ..... 323/266–271, 282, 908
See application file for complete search history.

(56) References Cited

U.S. PATENT DOCUMENTS

| | | | | |
|---|---|---|---|---|
| 4,719,369 | A * | 1/1988 | Asano et al. | 326/30 |
| 7,577,205 | B1 * | 8/2009 | Liu | 375/258 |
| 7,773,359 | B2 * | 8/2010 | Hinterscher | 361/93.9 |
| 7,923,975 | B2 * | 4/2011 | Liu et al. | 323/224 |
| 7,948,720 | B2 | 5/2011 | Mok | |
| 2009/0278518 | A1 | 11/2009 | Takagi | |

FOREIGN PATENT DOCUMENTS

CN 101978586 A 2/2011

* cited by examiner

*Primary Examiner* — Adolf Berhane
*Assistant Examiner* — Yemane Mehari
(74) *Attorney, Agent, or Firm* — Winston Hsu; Scott Margo

(57) ABSTRACT

A regulator includes a first amplifier, a second amplifier, a current control circuit, a first P-type metal-oxide-semiconductor transistor, a second P-type metal-oxide-semiconductor transistor, and a feedback circuit. The current control circuit includes a controller and at least one switch, and a second terminal of the first P-type metal-oxide-semiconductor transistor is coupled to a second terminal of the second P-type metal-oxide-semiconductor transistor. The regulator utilizes the controller to turn off the at least one switch during operation of the regulator in a light load mode, and the regulator utilizes the controller to turn on the at least one switch in turn when the regulator changes from the light load mode to a heavy load mode. Thus, the regulator can quickly recover a load current in the heavy load mode.

5 Claims, 9 Drawing Sheets

REGULATOR CAPABLE OF RAPIDLY RECOVERING AN OUTPUT VOLTAGE AND A LOAD CURRENT THEREOF

BACKGROUND OF THE INVENTION

1. Field of the Invention

The present invention is related to a regulator, and particularly to a regulator that can rapidly recover an output voltage and a load current of the regulator when the regulator enters a heavy load mode from a light load mode.

2. Description of the Prior Art

Please refer to FIG. 1A and FIG. 1B. FIG. 1A is a diagram illustrating a regulator 100 according to the prior art, and FIG. 1B is a diagram illustrating a load current Iload, a first driving current I1 and an output voltage Vout of the regulator 100 during operation of the regulator 100 in a heavy load mode and a light load mode. As shown in FIG. 1A, when the regulator 100 enters the light load mode (power saving mode), a first amplifier 102 and a first P-type metal-oxide-semiconductor transistor 104 are turned off, resulting in the first driving current I1 flowing through the first P-type metal-oxide-semiconductor transistor 104 being reduced to zero. Meanwhile, a second amplifier 106 and a second P-type metal-oxide-semiconductor transistor 108 are still turned on, so a second driving current I2 flowing through the second P-type metal-oxide-semiconductor transistor 108 is still supplied to a load 110 and a feedback circuit 112. As shown in FIG. 1B, when the regulator 100 enters the light load mode, the load current Iload is decreased and the first driving current I1 is reduced to zero. However, the output voltage Vout of the regulator 100 is still unchanged due to turning-on of the second amplifier 106 and the second P-type metal-oxide-semiconductor transistor 108.

When the regulator 100 enters the heavy load mode from the light load mode, the first amplifier 102 and the first P-type metal-oxide-semiconductor transistor 104 are turned on again. As shown in FIG. 1B, the load current Iload is increased rapidly, and the first driving current I1 is increased slowly because a voltage drop between a source terminal and a gate terminal of the first P-type metal-oxide-semiconductor transistor 104 is increased more slowly. Meanwhile, because the load current Iload is increased rapidly, and the first driving current I1 is increased slowly, the output voltage Vout of the regulator 100 is decreased until the first driving current I1 is stable. Therefore, the regulator 100 temporarily cannot provide a stable voltage to the load 110 when the regulator 100 enters the heavy load mode from the light load mode.

SUMMARY OF THE INVENTION

An embodiment provides a regulator. The regulator includes a first amplifier, a second amplifier, a current control circuit, a first P-type metal-oxide-semiconductor transistor, a second P-type metal-oxide-semiconductor transistor, and a feedback circuit. The first amplifier has a first input terminal for receiving a reference voltage, a second input terminal, and an output terminal. The second amplifier has a first input terminal for receiving the reference voltage, a second input terminal, and an output terminal coupled to the output terminal of the first amplifier. The current control circuit has a first terminal for receiving a first voltage, and a second terminal. The first P-type metal-oxide-semiconductor transistor has a first terminal coupled to the second terminal of the current control circuit, a second terminal coupled to the output terminal of the first amplifier, and a third terminal coupled to an output terminal of the regulator. The second P-type metal-oxide-semiconductor transistor has a first terminal for receiving the first voltage, a second terminal coupled to the output terminal of the second amplifier, and a third terminal coupled to the output terminal of the regulator. The feedback circuit has a first terminal coupled to the output terminal of the regulator, and a second terminal coupled to the second input terminal of the first amplifier and the second input terminal of the second amplifier.

The present invention provides a regulator. The regulator couples a second terminal of a first P-type metal-oxide-semiconductor transistor to a second terminal of a second P-type metal-oxide-semiconductor transistor through a transmission unit to maintain a voltage drop between a first terminal and the second terminal of the first P-type metal-oxide-semiconductor transistor. In addition, the regulator utilizes a current control circuit to control a current flowing through the first P-type metal-oxide-semiconductor transistor. Thus, an output voltage of the regulator is not decreased significantly by a load current being increased rapidly when the regulator enters a heavy load mode from a light load mode.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
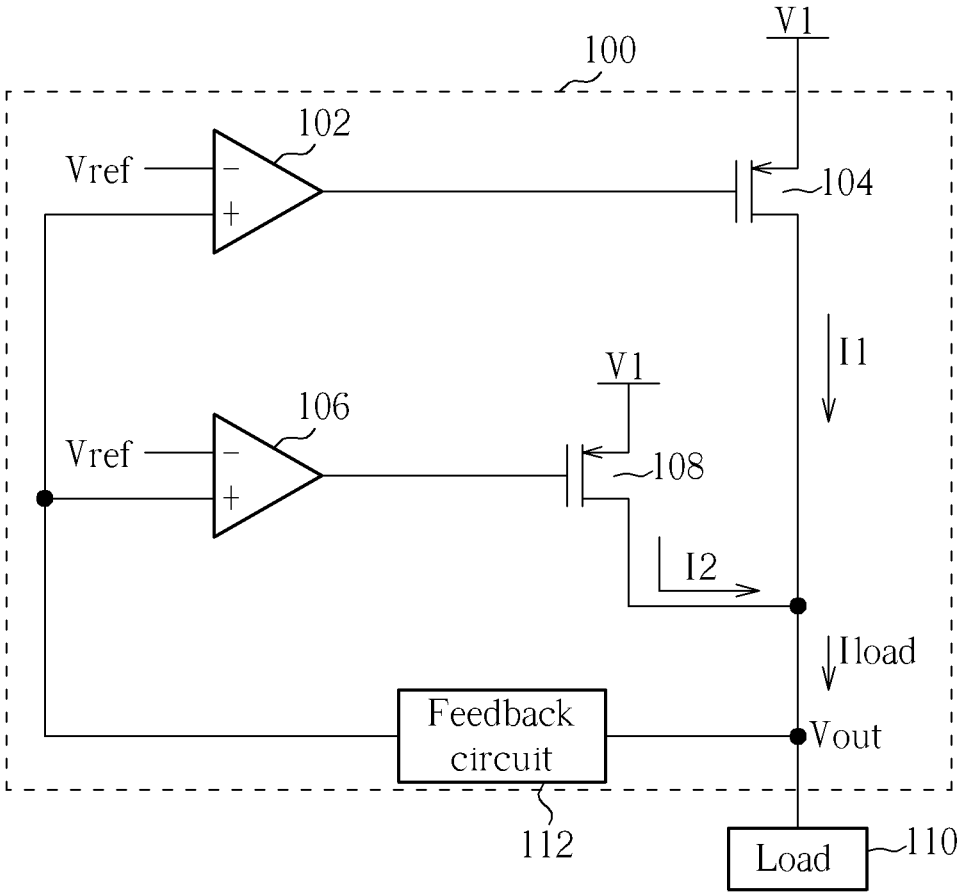
FIG. 1A PRIOR ART
FIG. 1A is a diagram illustrating a regulator according to the prior art.
Figure 1B:
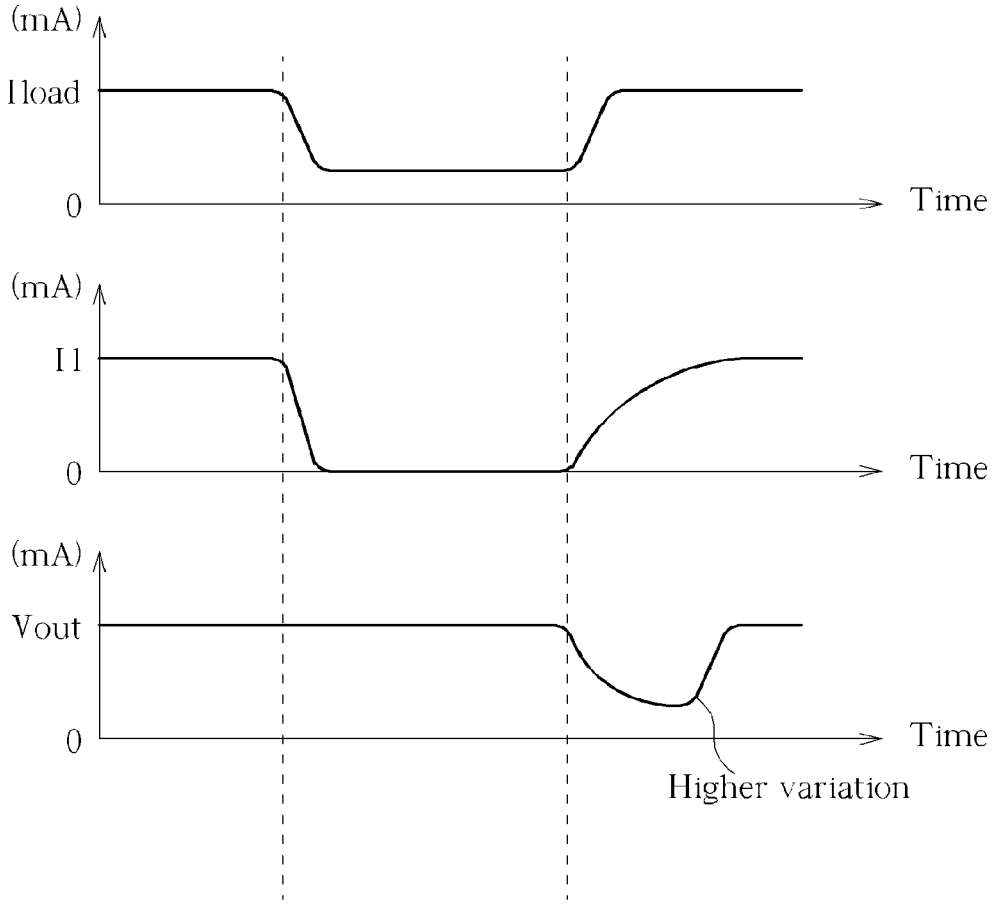
FIG. 1B PRIOR ART
FIG. 1B a diagram illustrating a load current, a first driving current and an output voltage of the regulator during operation of the regulator in a heavy load mode and a light load mode.
Figure 2A:
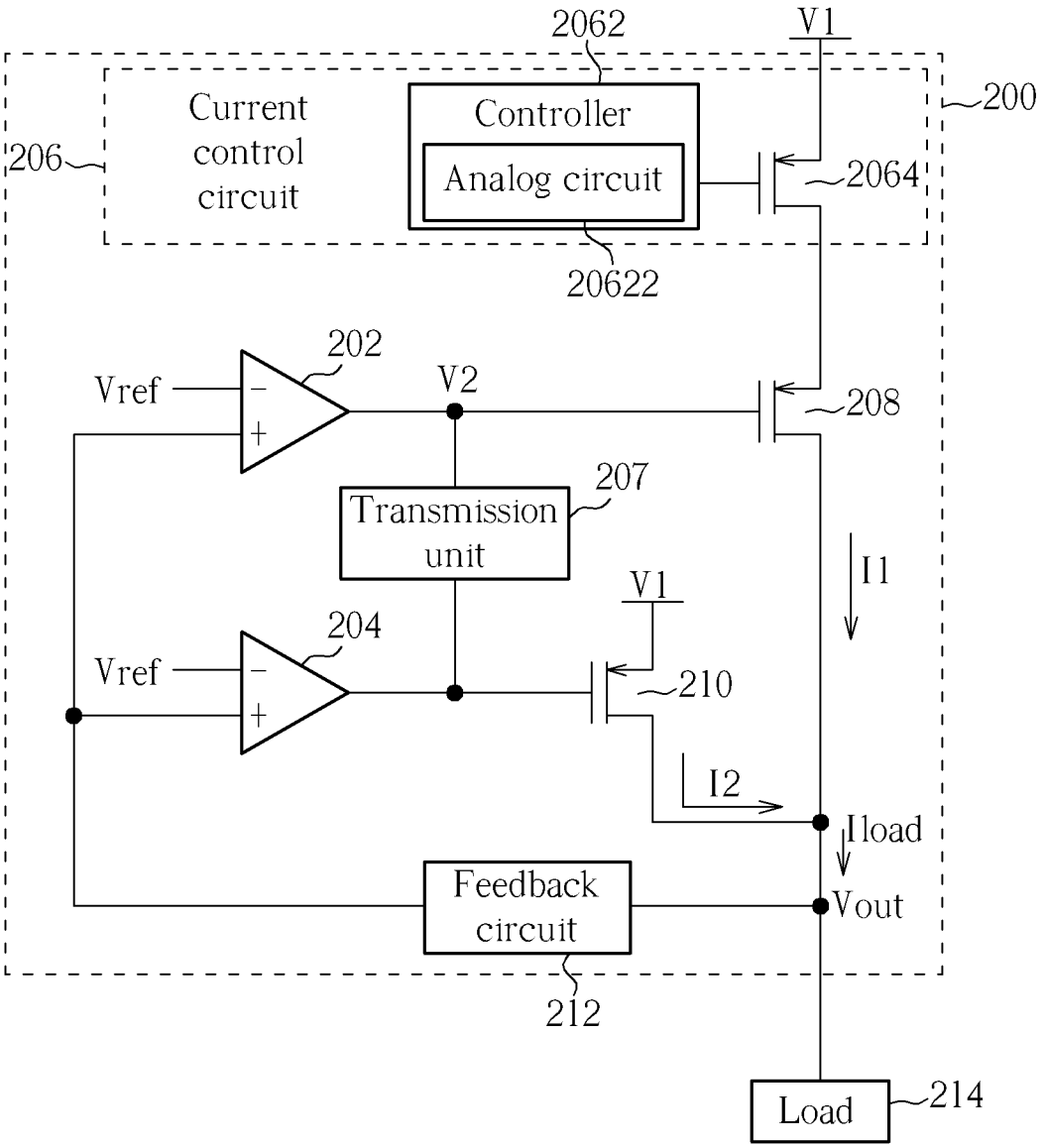
FIG. 2A is a diagram illustrating a regulator according to an embodiment.
Figure 2B:
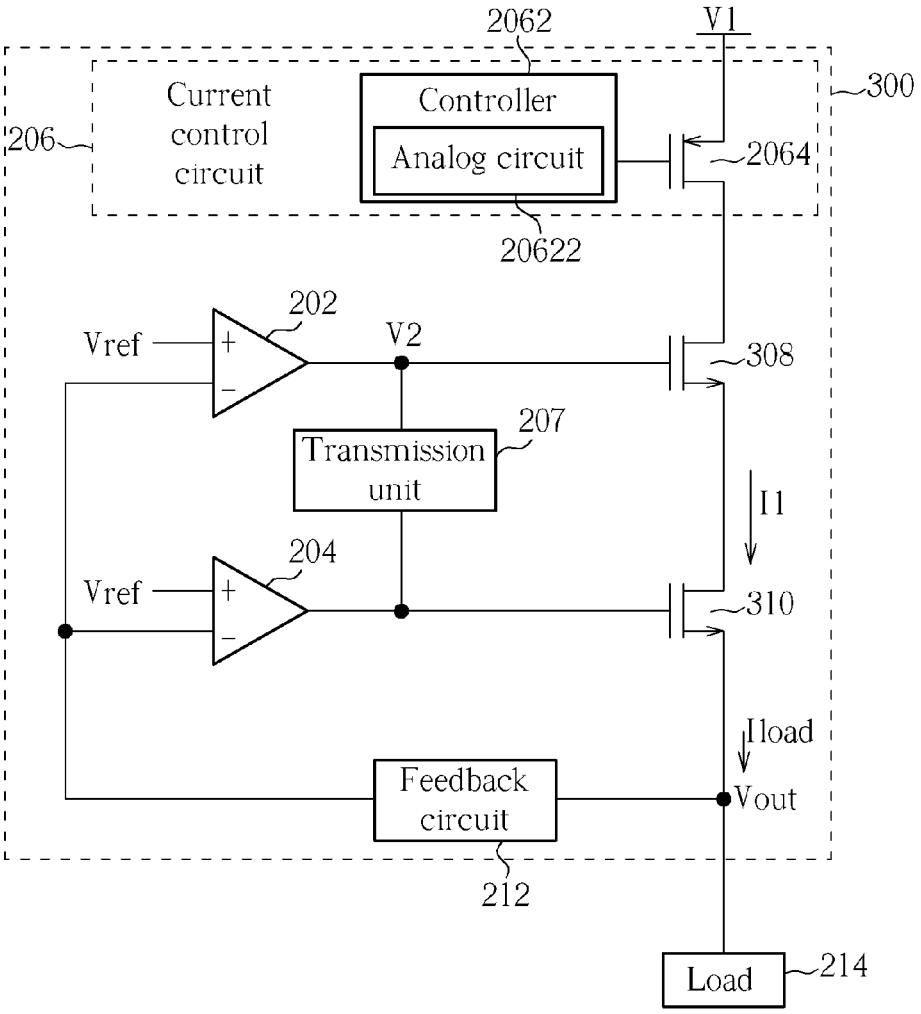
FIG. 2B is a diagram illustrating a regulator according to another embodiment.

Please refer to FIG. 2A. FIG. 2A is a diagram illustrating a regulator 200 according to an embodiment. The regulator 200 includes a first amplifier 202, a second amplifier 204, a current control circuit 206, a first P-type metal-oxide-semiconductor transistor 208, a transmission unit 207, a second P-type metal-oxide-semiconductor transistor 210, and a feedback circuit 212. The first amplifier 202 has a first input terminal for receiving a reference voltage Vref, a second input terminal, and an output terminal. The second amplifier 204 has a first input terminal for receiving the reference voltage Vref, a second input terminal, and an output terminal coupled to the output terminal of the first amplifier 202. The current control circuit 206 has a first terminal for receiving a first voltage V1 (such as 2.5V), and a second terminal. But, the present invention is not limited to the first voltage V1 being 2.5V. The first P-type metal-oxide-semiconductor transistor 208 has a first terminal coupled to the second terminal of the current control circuit 206, a second terminal coupled to the output terminal of the first amplifier 202, and a third terminal coupled to an output terminal of the regulator 200. The second P-type metal-oxide-semiconductor transistor 210 has a first terminal for receiving the first voltage V1, a second terminal coupled to the output terminal of the second amplifier 204, and a third terminal coupled to the output terminal of the regulator 200. The feedback circuit 212 has a first terminal coupled to the output terminal of the regulator 200, and a second terminal coupled to the second input terminal of the first amplifier 202 and the second input terminal of the second amplifier 204. In addition, the current control circuit 206 includes a controller 2062 and a switch 2064. The controller 2062 has an output terminal and an analog circuit 20622. The switch 2064 has a first terminal coupled to the first terminal of the current control circuit 206 for receiving the first voltage V1, a second terminal coupled to an output terminal of the controller 2062, and a third terminal coupled to the second terminal of the current control circuit 206. In addition, the regulator 200 utilizes the first amplifier 202, the second amplifier 204, and the feedback circuit 212 to limit an output voltage Vout to a predetermined voltage (such as 1.6V). But, the present invention is not limited to the output voltage Vout being fixed to 1.6V. Please refer to FIG. 2B. FIG. 2B is a diagram illustrating a regulator 300 according to another embodiment. A difference between the regulator 300 and the regulator 200 is that the regulator 300 substitutes a first N-type metal-oxide-semiconductor transistor 308 and a second N-type metal-oxide-semiconductor transistor 310 for the first P-type metal-oxide-semiconductor transistor 208 and the second P-type metal-oxide-semiconductor transistor 210, respectively. Further, subsequent operational principles of the regulator 300 are the same as those of the regulator 200, so further description thereof is omitted for simplicity.

Figure 3:
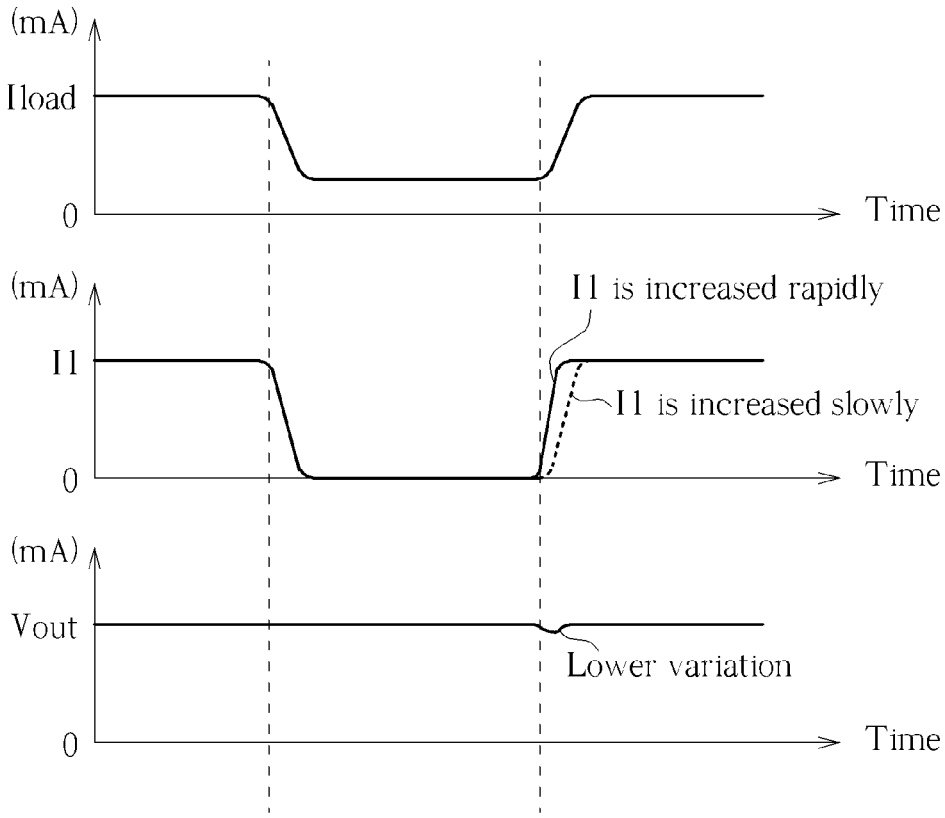
FIG. 3 is a diagram illustrating a load current, a first driving current and the output voltage of the regulator during operation of the regulator a heavy load mode and a light load mode.

Please refer to FIG. 3. FIG. 3 is a diagram illustrating a load current Iload, a first driving current I1, and the output voltage Vout of the regulator 200 during operation of the regulator 200 in a heavy load mode and a light load mode. When the regulator 200 enters the light load mode (power saving mode), the first amplifier 202 is turned off, and the switch 2064 is turned off by the controller 2062 of the current control circuit 206, resulting in the first driving current I1 flowing through the first P-type metal-oxide-semiconductor transistor 208 being reduced to zero. Meanwhile, the second amplifier 204 and the second P-type metal-oxide-semiconductor transistor 210 are still turned on, so a second driving current I2 flowing through the second P-type metal-oxide-semiconductor transistor 210 is still supplied for a load 214 and the feedback circuit 212. Therefore, as shown in FIG. 2A and FIG. 3, when the regulator 200 enters the light load mode (power saving mode), the load current Iload is decreased and the first driving current I1 is reduced to zero. However, the output voltage Vout of the regulator 200 is still unchanged due to turning-on of the second amplifier 204 and the second P-type metal-oxide-semiconductor transistor 210. In addition, the second terminal of the first P-type metal-oxide-semiconductor transistor 208 is coupled to the second terminal of the second P-type metal-oxide-semiconductor transistor 210 through the transmission unit 207, so a voltage of the second terminal of the first P-type metal-oxide-semiconductor transistor 208 is kept at a second voltage V2 (such as 1.6V) due to turning-on of the second P-type metal-oxide-semiconductor transistor 210 during operation of the regulator 200 in the light load mode. That is to say, a voltage drop between the first terminal and the second terminal of the first P-type metal-oxide-semiconductor transistor 208 is kept at a voltage drop between the first terminal and the second terminal when the first P-type metal-oxide-semiconductor transistor 208 is turned on. But, the present invention is not limited to the second voltage V2 being 1.6V.

When the regulator 200 enters the heavy load mode from the light load mode, the first amplifier 202 is turned on, and the switch 2064 is turned on by the controller 2062 of the current control circuit 206. As shown in FIG. 3, the load current Iload is increased rapidly, but the first driving current I1 is also increased rapidly due to the voltage drop between the first terminal and the second terminal of the first P-type metal-oxide-semiconductor transistor 208 being kept at the voltage drop between the first terminal and the second terminal when the first P-type metal-oxide-semiconductor transistor 208 is turned on. Because the load current Iload and the first driving current I1 are increased rapidly, variation of the output voltage Vout of the regulator 200 is lower when the regulator 200 enters the heavy load mode from the light load mode. As shown in FIG. 3, when the regulator 200 enters the heavy load mode from the light load mode, the controller 2062 can control the switch 2064 to be turned on immediately for controlling the first driving current I1 to be increased rapidly according to the load current Iload sunk by the load 214. Or, when the regulator 200 enters the heavy load mode from the light load mode, the controller 2062 can control the switch 2064 to be turned on slowly by the analog circuit 20622 for controlling the first driving current I1 to be increased slowly according to the load current Iload sunk by the load 214.

Figure 4:
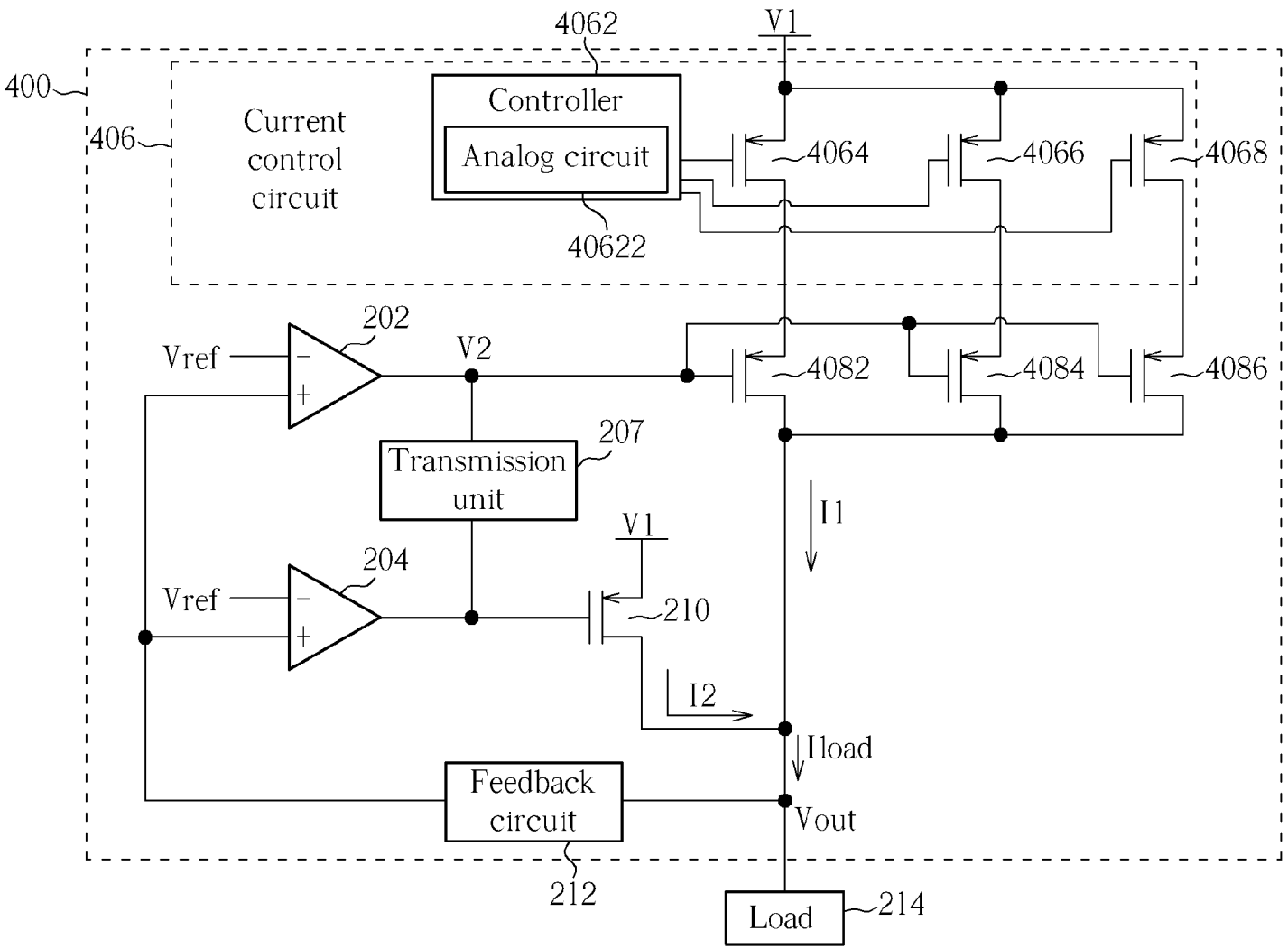
FIG. 4 is a diagram illustrating a regulator according to another embodiment
Figure 5:
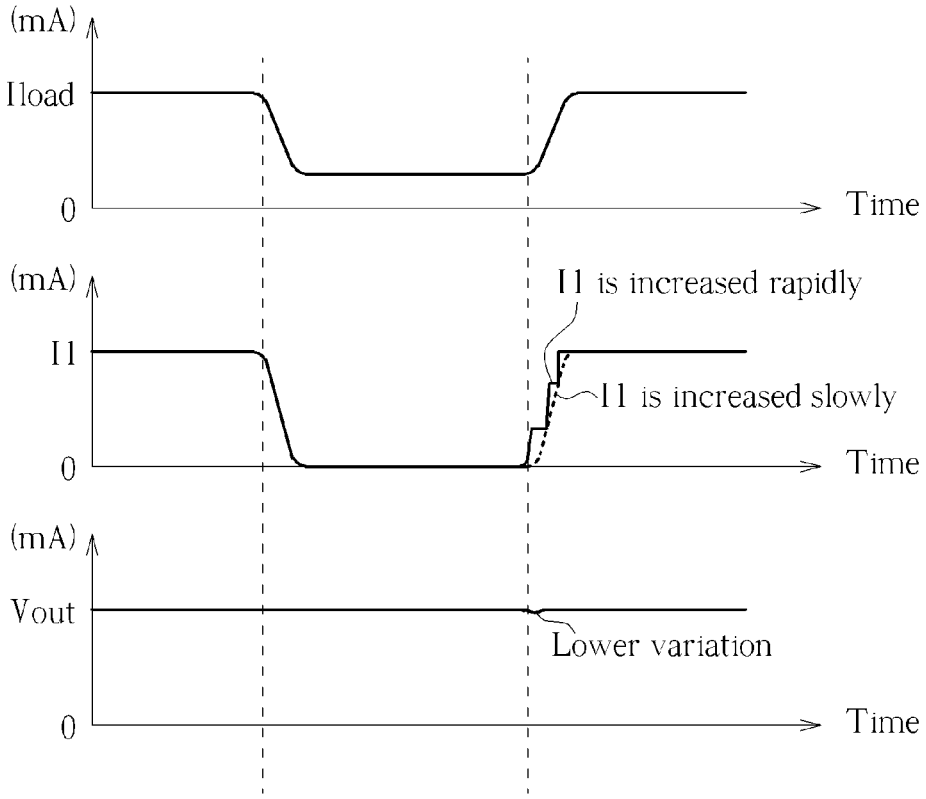
FIG. 5 is a diagram illustrating a load current, a first driving current and an output voltage of the regulator during operation of the regulator in a heavy load mode and a light load mode.

Please refer to FIG. 4 and FIG. 5. FIG. 4 is a diagram illustrating a regulator 400 according to another embodiment, and FIG. 5 is a diagram illustrating a load current Iload, a first driving current I1, and an output voltage Vout of the regulator 400 during operation of the regulator 400 in a heavy load mode and a light load mode. A difference between the regulator 400 and the regulator 200 is that a current control circuit 406 of the regulator 400 includes three switches 4064, 4066, 4068 and three first P-type metal-oxide-semiconductor transistors 4082, 4084, 4086. When the regulator 400 enters the light load mode (power saving mode), operational principles of the regulator 400 are the same as those of the regulator 200, so further description thereof is omitted for simplicity. But, the present invention is not limited to the three switches 4064, 4066, 4068 and the three first P-type metal-oxide-semiconductor transistors 4082, 4084, 4086. Any regulator including at least one switch to control the first driving current I1 falls within the scope of the present invention.

When the regulator 400 enters the heavy load mode from the light load mode, the first amplifier 202 is turned on and the switches 4064, 4066, 4068 are turned on in turn by a controller 4062 of the current control circuit 406. As shown in FIG. 5, the load current Iload is increased rapidly, but the first driving current I1 is also increased rapidly due to voltage drops between first terminals and second terminals of the first P-type metal-oxide-semiconductor transistors 4082, 4084, 4086 being kept at voltage drops between the first terminals and the second terminals when the first P-type metal-oxide-semiconductor transistors 4082, 4084, 4086 are turned on. Because the load current Iload and the first driving current I1 are increased rapidly, variation of the output voltage Vout of the regulator 400 is lower when the regulator 400 enters the heavy load mode from the light load mode. As shown in FIG. 5, when the regulator 400 enters the heavy load mode from the light load mode, the controller 4062 can control the switches

4064, 4066, 4068 to be turned on in turn according to the load current Iload sunk by the load 214. Therefore, as shown in FIG. 5, the first driving current I1 is increased similar to a staircase. In addition, the controller 4062 can also control each of the switches 4064, 4066, 4068 to be turned on slowly by the analog circuit 40622 for controlling the first driving current I1 to be increased slowly.

Figure 6:
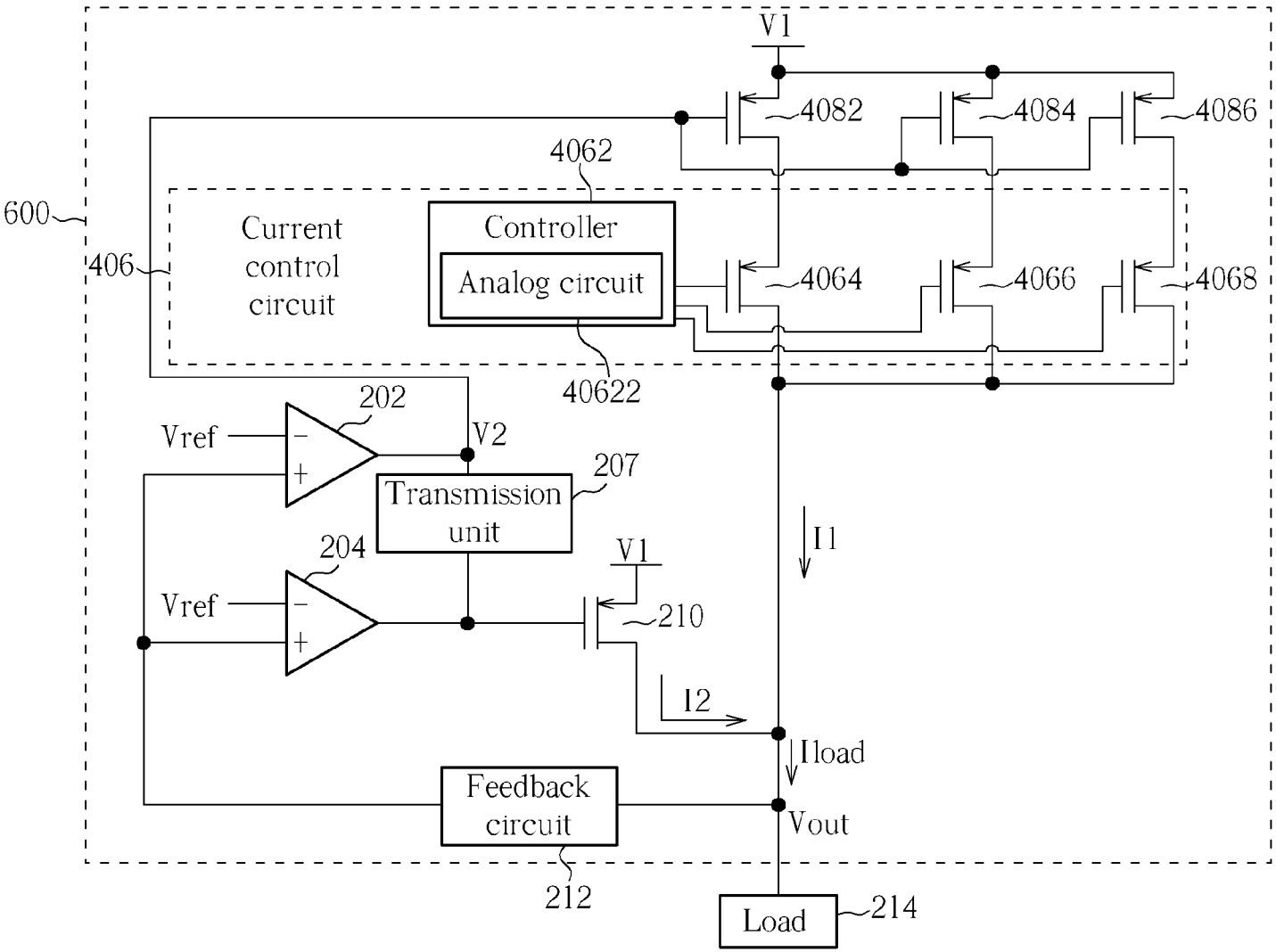
FIG. 6 is a diagram illustrating a regulator according to another embodiment.

Please refer to FIG. 6. FIG. 6 is a diagram illustrating a regulator 600 according to another embodiment. A difference between the regulator 600 and the regulator 400 is that coupling relationships between the three first P-type metal-oxide-semiconductor transistors 4082, 4084, 4086 and the three switches 4064, 4066, 4068 of the regulator 600 are different from those of the regulator 400. Further, subsequent operational principles of the regulator 600 are the same as those of the regulator 400, so further description thereof is omitted for simplicity.

Figure 7:
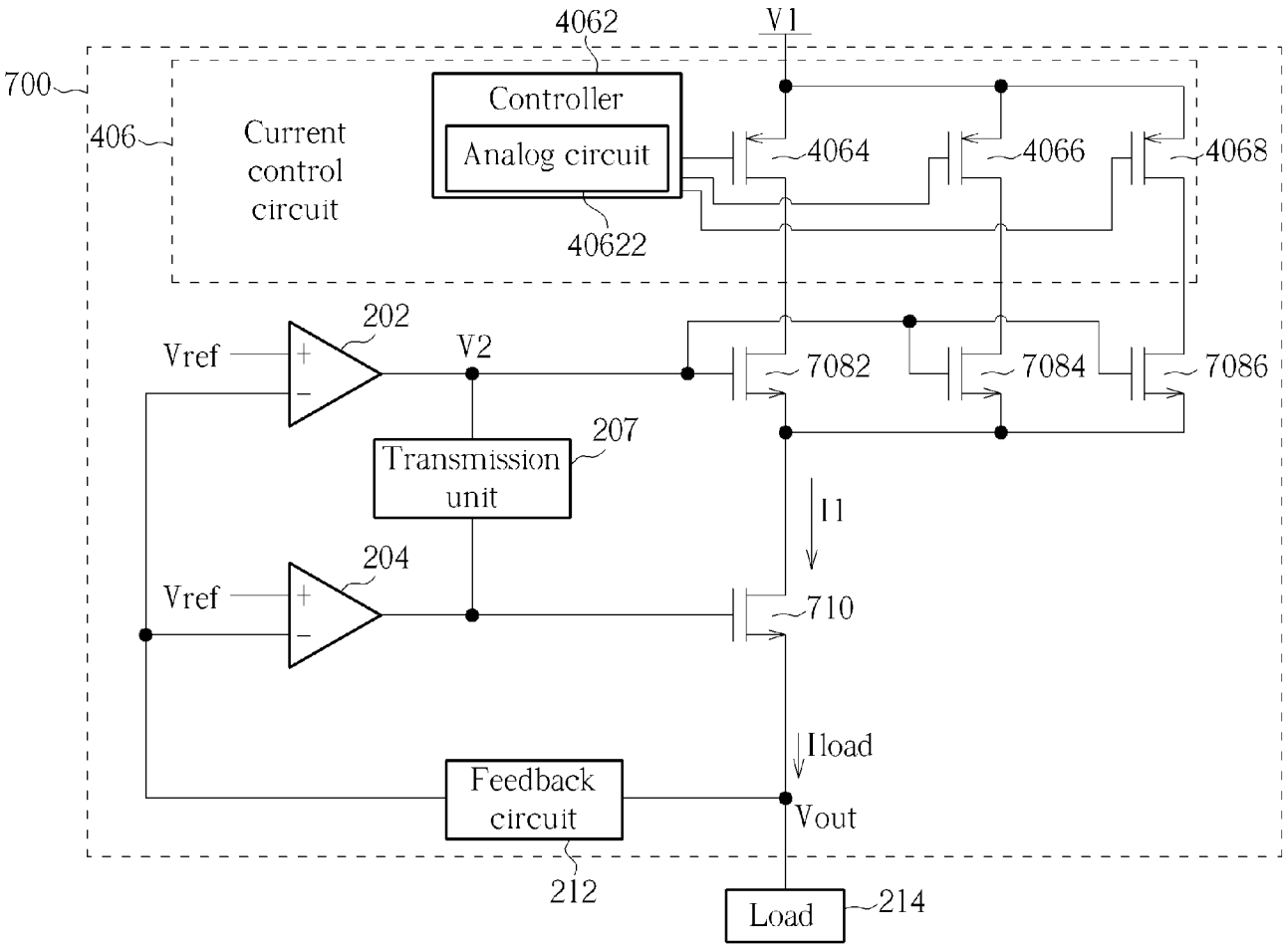
FIG. 7 is a diagram illustrating a regulator according to another embodiment.

Please refer to FIG. 7. FIG. 7 is a diagram illustrating a regulator 700 according to another embodiment. A difference between the regulator 700 and the regulator 300 is that the regulator 700 substitutes three first N-type metal-oxide-semiconductor transistors 7082, 7084, 7086 and a second N-type metal-oxide-semiconductor transistor 710 for the three first P-type metal-oxide-semiconductor transistors 4082, 4084, 4086 and the second P-type metal-oxide-semiconductor transistor 210, respectively. Further, subsequent operational principles of the regulator 700 are the same as those of the regulator 400, so further description thereof is omitted for simplicity.

To sum up, the regulator provided by the present invention couples the second terminal (gate terminal) of the first P-type metal-oxide-semiconductor transistor to the second terminal (gate terminal) of the second P-type metal-oxide-semiconductor transistor through the transmission unit to maintain the voltage drop between the first terminal (source terminal) and the second terminal (gate terminal) of the first P-type metal-oxide-semiconductor transistor. In addition, the regulator provided by the present invention utilizes the current control circuit to control the current flowing through the first P-type metal-oxide-semiconductor transistor. Thus, the output voltage of the regulator is not decreased significantly by the load current being increased rapidly when the regulator enters the heavy load mode from the light load mode.

Those skilled in the art will readily observe that numerous modifications and alterations of the device and method may be made while retaining the teachings of the invention.

What is claimed is:

1. A regulator, comprising:

a first amplifier having a first input terminal for receiving a reference voltage, a second input terminal, and an output terminal;

a second amplifier having a first input terminal for receiving the reference voltage, a second input terminal, and an output terminal;

a transmission unit coupled between the output terminal of the first amplifier and the output terminal of the second amplifier, wherein the output terminal of the first amplifier is coupled to the output terminal of the second amplifier through the transmission unit, and the transmission unit is kept turning on;

a current control circuit having a first terminal for receiving a first voltage, and a second terminal;

a first P-type metal-oxide-semiconductor transistor having a first terminal coupled to the second terminal of the current control circuit, a second terminal coupled to the output terminal of the first amplifier, and a third terminal coupled to an output terminal of the regulator;

a second P-type metal-oxide-semiconductor transistor having a first terminal for receiving the first voltage, a second terminal coupled to the output terminal of the second amplifier, and a third terminal coupled to the output terminal of the regulator; and a feedback circuit having a first terminal coupled to the output terminal of the regulator, and a second terminal coupled to the second input terminal of the first amplifier and the second input terminal of the second amplifier;

wherein the transmission unit is used for keeping a voltage drop between the first terminal and the second terminal of the first P-type metal-oxide-semiconductor transistor during operation of the regulator in a light load mode at a voltage drop between the first terminal and the second terminal when the first P-type metal-oxide-semiconductor transistor is turned on.

2. The regulator of claim 1, wherein the current control circuit comprises:

a controller having at least one output terminal; and at least one switch, each switch having a first terminal coupled to the first terminal of the current control circuit for receiving the first voltage, a second terminal coupled to an output terminal of the controller corresponding to the switch, and a third terminal coupled to the second terminal of the current control circuit.

3. The regulator of claim 2, wherein the controller further comprises an analog circuit.

4. The regulator of claim 2, wherein the controller turns off the at least one switch during operation of the regulator in the light load mode.

5. The regulator of claim 2, wherein the controller turns on the at least one switch in turn when the regulator enters a heavy load mode from the light load mode.

* * * * *